US005331985A

United States Patent [19]

Lyons

[11] Patent Number: 5,331,985

[45] Date of Patent: Jul. 26, 1994

[54] CLEANING APPARATUS

[76] Inventor: Richard C. Lyons, 7734 Seminary Ridge, Worthington, Ohio 43235

[21] Appl. No.: 933,333

[22] Filed: Aug. 21, 1992

[51] Int. Cl.[5] ..... B08B 3/02

[52] U.S. Cl. ..... 134/66; 134/198; 134/201

[58] Field of Search ..... 134/66, 123, 198, 201, 134/68

[56] References Cited

U.S. PATENT DOCUMENTS

| | | | |
|---|---|---|---|
| 1,201,475 | 10/1916 | Lank | 134/66 |
| 1,215,107 | 2/1917 | Bush | 134/66 |
| 2,647,525 | 8/1953 | Duda et al. | 134/134 |
| 3,096,775 | 7/1963 | Clarke et al. | 134/123 |
| 3,258,019 | 6/1966 | Bellas et al. | 134/123 |
| 3,289,239 | 12/1966 | Sorenson et al. | 134/123 |
| 3,538,886 | 11/1970 | Patterson | 134/66 |
| 3,698,029 | 10/1972 | Pulliam | 134/123 X |

*Primary Examiner*—Frankie L. Stinson

*Attorney, Agent, or Firm*—Thompson, Hine and Flory

[57] ABSTRACT

A transportable cleaning apparatus for cleaning a part at a location where the part to be cleaned is used. The cleaning apparatus includes an enclosure for containing a cleaning solution. The apparatus further includes devices for introducing the cleaning agent into the enclosure and for removing the spent cleaning agent from the enclosure. Precleaning and post-cleaning workstations may also be utilized.

11 Claims, 4 Drawing Sheets

CLEANING APPARATUS

FIELD OF THE INVENTION

The invention relates generally to the area of cleaning devices; and in particular, the invention provides a transportable apparatus for cleaning air conditioning units, heat/cool systems, heat exchanger coils and other devices.

DESCRIPTION OF THE RELATED ART

A typical refrigeration-type air conditioning unit contains two heat exchangers. First, air to be cooled, typically interior room air, passes through a first heat exchanger in which heat from the room air is transferred to a cooling medium in the heat exchanger. Next, a second heat exchanger transfers heat from the cooling medium to another medium such as outside air. Generally, the air is forced through the heat exchangers by a fan.

Heat exchangers are generally comprised of a plurality of parallel tubes through which the cooling medium flows. Connected to those tubes are heat exchange elements which typically are very thin, closely spaced and have relatively large surface areas thereby maximizing the transfer of heat between the air flowing across the heat exchange elements and the cooling medium flowing through the tubes.

Therefore, the efficiency of an air conditioning unit is directly related to the free-flow of air through the heat exchangers. However, during its operation, it is not unusual for dust, lint and other for airborne particles to become lodged between the heat exchange elements thereby blocking the flow of air and reducing the efficiency of the heat exchange process and the air conditioning unit. The blockage may be accelerated by condensation of moisture on the heat exchange elements. Further, the accumulation of dirt may result in bacterial or mold growth which may adversely affect the quality of the air passing through the heat exchanger.

Consequently, an air conditioner requires periodic maintenance to clean the heat exchange elements. A great number of offices, hotel and motel rooms, apartments and other living areas utilize a self-contained room air conditioner in which the air conditioner unit, including the heat exchangers, is mounted on a base which slides into an exterior housing or sleeve. To avoid soiling the area in which the air conditioner is located, the air conditioner is removed from the housing and transported to an outside area where it is cleaned. The transportation of the air conditioner unit to an outside location requires additional labor and handling of the unit and therefore contributes substantially to the cost of cleansing such units.

SUMMARY OF THE INVENTION

To eliminate the requirement of transporting air conditioners to an outside environment to be cleaned, applicant claims a cleaning apparatus which has the advantage of being transportable to the location of the air conditioner. The cleaning apparatus has an enclosure for holding the air conditioner to be cleaned and for containing a cleaning solution within the enclosure during the cleaning process. The enclosure further includes opposing sidewalls, a sump, and a plurality of access areas between the interior and exterior of the enclosure. A first access permits the air conditioner to be transferred into the enclosure. The enclosure further includes a first part support for holding the air conditioner over the sump, wheels and a second access, either through the top of the enclosure, or the sidewalls, for receiving the spraying unit to facilitate the cleaning process.

In a first embodiment, the first access is located at one end of the enclosure between the sidewalls, and the first part support includes a plurality of rollers thereby facilitating the conveyance of the air conditioner unit into and within the enclosure. The enclosure further includes a spraying unit for introducing a cleaning solution into the enclosure. In a second embodiment, a first workstation is located adjacent the first access; and in a third embodiment, a second workstation is located adjacent a third access at an opposing end of the enclosure.

DETAILED DESCRIPTION

Figure 1:
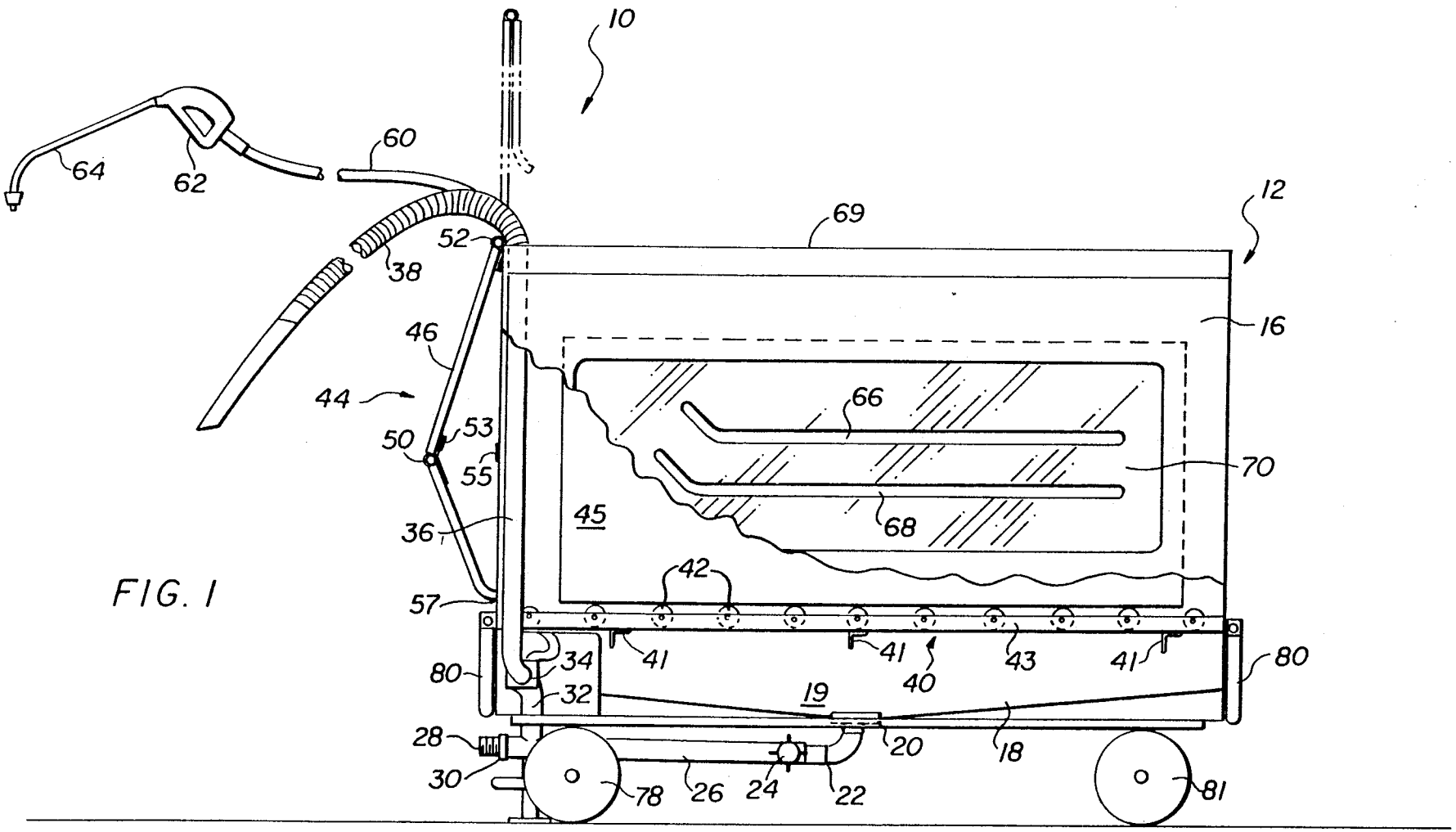
FIG. 1 is a schematic side view of a first embodiment of a cleaning apparatus of the present invention.
Figure 3:
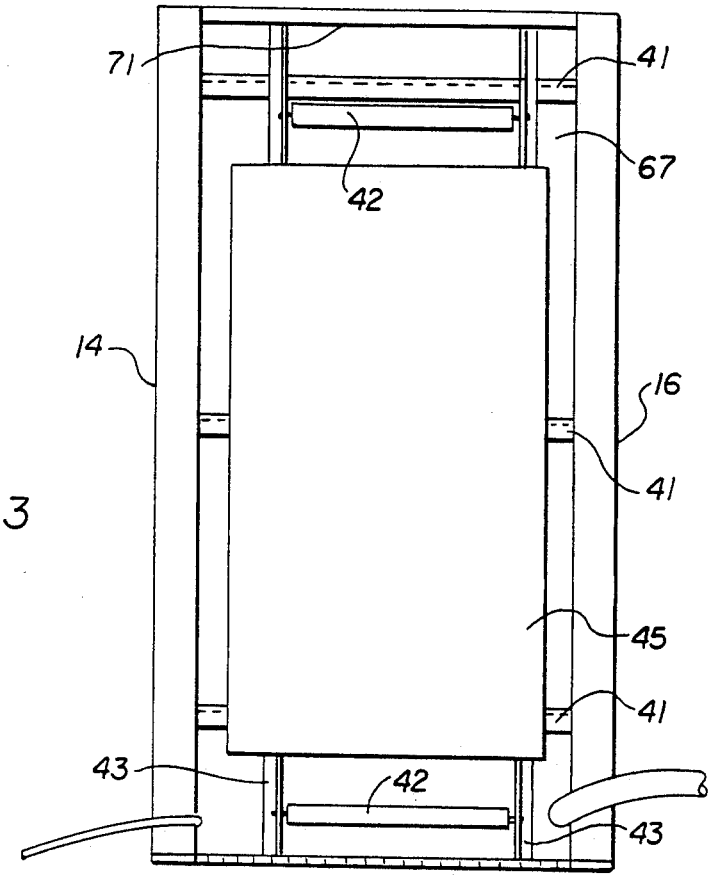
FIG. 3 is a schematic top view of the cleaning apparatus shown in FIG. 1.
Figure 2:
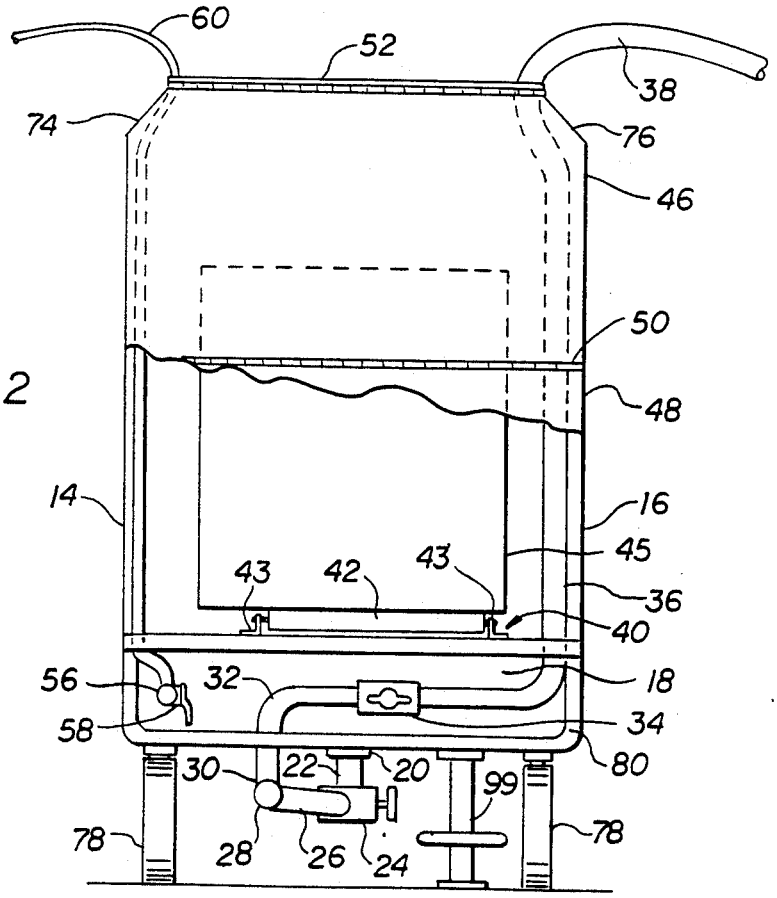
FIG. 2 is a schematic end view of the cleaning apparatus shown in FIG. 1.

FIGS. 1, 2 and 3 are schematic side, end and top views, respectively, of a first embodiment of the present invention. The cleaning apparatus 10, includes an enclosure 12, having opposing sidewalls 14 and 16. In FIG. 1, the sidewall is shown broken away to better illustrate the other details of the apparatus. A base plate 18, is connected to the walls 14 and 16. The base plate extends the full length of the apparatus and projects upwardly at each end, thereby forming a sump 19 contained between the base plate 18, and the lower portion of the sidewalls 14 and 16. The sump 19 is constructed to hold a cleaning solution without leakage. Preferably as shown in FIG. 1, the bottom area of the sump formed by the plate 18 is sloped to a drain 20.

A first drain pipe section 22, connects the drain 20, to a valve 24, which is used to control the flow of liquid from the sump. A further drain pipe 26, is connected to the valve 24, and terminates at a connection 28. While liquid may be drained from the sump by simple gravity flow, in the preferred embodiment, the connection 28 is connected to a source of vacuum. Also connected to the drain pipe 26 is a T-connector 30, which is further connected to drain pipe 32, valve 34, stand pipe 36 and flexible vacuum hose 38. The valve 34, is used to control the connection of the vacuum hose 38, to a vacuum source, applied to the connector 28. Therefore, using valves 24 and 34, a liquid may be drawn from either or both the sump 19 and the vacuum hose 38.

Within the enclosure 12, a first part support 40 is located above the sump and includes cross members 41 supported between the walls 14 and 16. The first part support further includes a plurality of rollers 42 rotatably mounted in a pair of roller supports 43 which are supported by the cross members 41. As shown in FIG. 2, the rollers are not centrally located across the width of the enclosure. The rollers are illustrated as long cylindrical rollers; however, instead of the long cylindrical rollers, two parallel rows of smaller skate rollers may be used. The plurality of rollers 42 support an air conditioner 45 or other part to be cleaned and facilitate conveyance of the air conditioner into and within the enclosure 12.

In the preferred embodiment, first access means 44 is located at one end of the enclosure between the sidewalls 14 and 16. The first access is comprised of bi-folding movable door panels 46 and 48, which are joined together by a first hinge 50 and connected to the enclosure by a second hinge 52. When moved to a first open position, the door panels are pivoted about the hinge 52, to rest on top of the enclosure 12, as shown in phantom in FIG. 1. When in that first position, the air conditioner or other part 45 may be transferred into the enclosure by sliding it over the rollers 42. After the air conditioner has been loaded into the cleaning apparatus, the bi-folding doors are moved to a second closed position in which they cover the first access and are effective for containing liquid within the enclosure during the cleaning process. Means for holding the doors closed such as VELCRO strips 53 and 55 located near the center hinge may be used. In the preferred embodiment, the lower edge 57 of door panel 48 is curved toward the interior of the unit to direct liquid to the sump 19.

It should be noted that the first access may have other equivalent constructions. For example, the first access may be comprised of a number of overlapping flexible strips which hang from the location of the hinge 52, and have a first position in which they are moved relative to each other, thereby permitting the air conditioner to be loaded into the enclosure. After being loaded, the strips will then hang in a second position in which they are approximately vertical and parallel to each other and effectively contain liquid within the enclosure.

The first access may be implemented by a single flap of material, which is moved out of the way for part loading and then moved to cover the access during the cleaning operation. Further, the door panels may be solid plastic or plastic sheet surrounded by a metal frame. The first access means may be comprised of various door panel configurations. Any enclosure or cover may be used which permits the part 45 to be loaded into the enclosure through the first access means and is thereafter effective to contain a liquid within the enclosure. It is not necessary that the first access be watertight or absolutely leakproof. It is preferred that the first access effectively contain cleaning solution within the enclosure 12.

After the part 45 has been loaded and the first access is covered or closed, the unit is cleaned by a spray of cleaning agent, such as high temperature water under pressure. The source of the cleaning agent may be a high pressure hose which is connected to a quick disconnect coupling 56, which in turn is connected to a high pressure valve 58. Flexible high pressure hose 60 is connected between the valve 58 and a high pressure spray gun 62. The gun 62 and attached wand 64 is manipulated within the enclosure through a second access means. The second access may be slots 66 and 68, which are contained in a transparent panel 70, affixed to each of the sidewalls. An alternative second access may be an opening 67 on a topside 69 of the enclosure 12. The gun 62 and wand 64 may be manipulated about the air conditioner 45 through the second access opening in the topside of the enclosure.

The end of the enclosure opposite the first access means 44 is illustrated in FIG. 1 as being a solid wall 71 covering that end of the enclosure. To better contain the spray, the upper sections 74 and 76 of side walls 14 and 16, respectively, may be formed toward each other, and thereby reducing the open area of the second access. To transport the unit, a first pair of wheels 78 which may be swiveling casters or rollers are attached to the enclosure. A second pair of wheels 81 which are nonswiveling casters or rollers are also attached to the enclosure. In addition, handles 80 are rotatably attached to the enclosure to facilitate its transportation.

Figure 4:
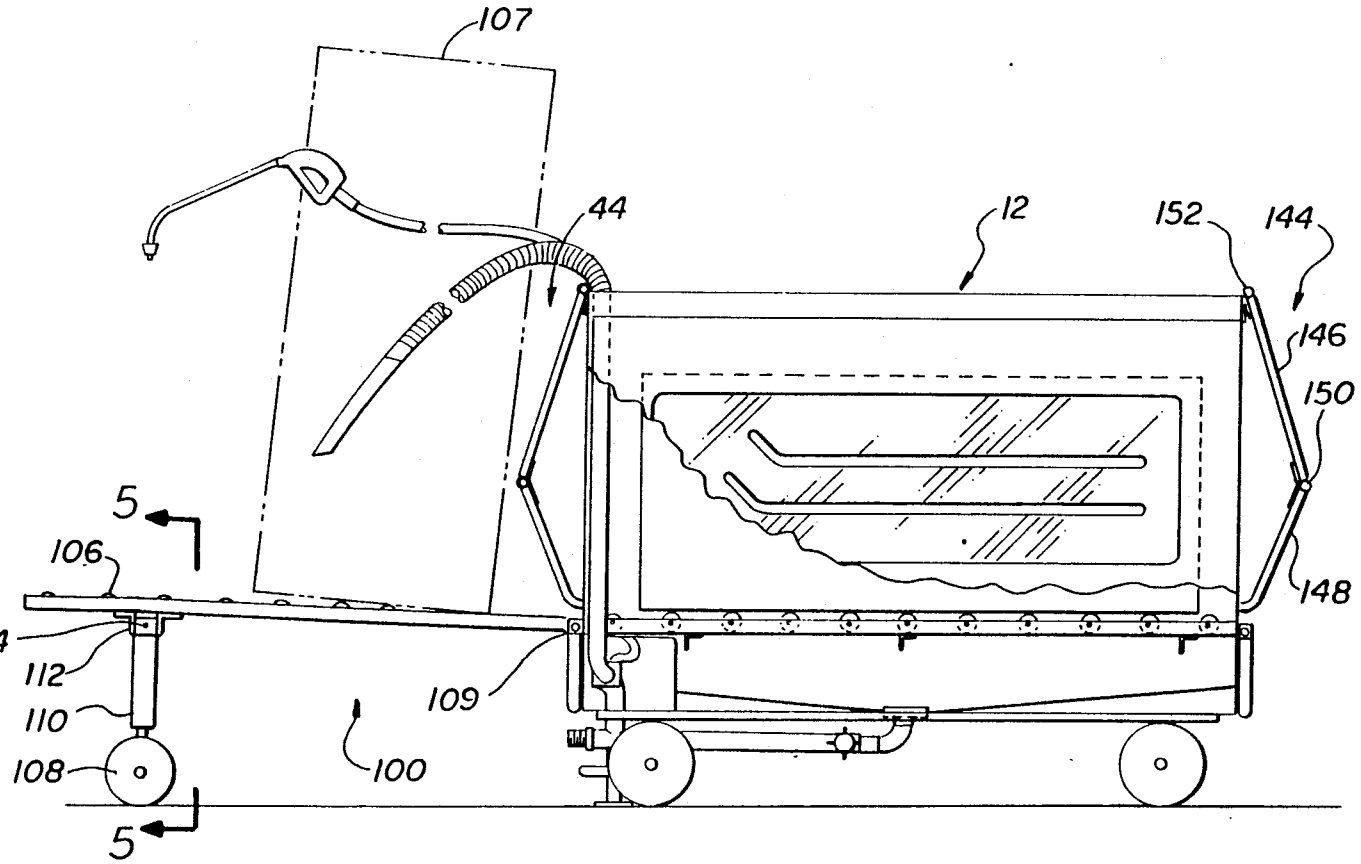
FIG. 4 is a schematic side view of a second embodiment of the cleaning apparatus of the present invention.
Figure 5:
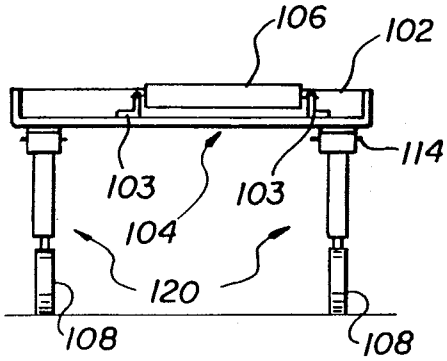
FIG. 5 is a view of section 5—5 of FIG. 4.

FIG. 4 is a schematic side view of a second embodiment of the cleaning apparatus of the present invention, and FIG. 5 is a section taken along 5—5 of FIG. 4. Attached to the enclosure 12 is a first workstation 100 which is comprised of a rectangular first base channel assembly 102, on which is affixed a second part support 104. The second part support is similar in construction to the first part support 40 and includes a pair of roller supports 103 and a plurality of rollers 106. The part support 100 is constructed so that the rollers 106 are approximately coplanar with the rollers 42 to facilitate conveyance of the air conditioner between the first workstation and the enclosure 12. The rollers 106 do not extend over the full length of the base assembly 102. The absence of rollers at one end of the base assembly 102 permits a part 107 shown in phantom to be supported on the rollers 106 and the base channel assembly 102. The workstation 100 contains a lip 108, which hooks over the edge of the base plate 18 at the one end of the enclosure 12.

The other end of the workstation 100, is supported by two leg assemblies 120, one on each side of the channel assembly 102. Each leg assembly is comprised of a wheel, caster or roller 108, is attached to a leg support 110, thereby permitting the first workstation to move with the enclosure 12. Each leg support 110 is held to the base channel assembly 102 by means of a socket 112, and pin 114. Removing the pins 114 permits the leg assemblies 120 to be disconnected from the first workstation and stored in association with the enclosure 12 when the cleaning apparatus is not in use. In addition, the leg assembly 120 has a length such that the other end of the workstation 100 is slightly elevated relative to the one end of the first workstation at the lip 108. That slight elevation permits cleaning agent to drain from the first workstation into the sump 18.

Air conditioners typically being cleaned will vary in weight from 50 to 100 pounds and therefore are extremely awkward to manipulate. In addition, different designs may require that after being removed from their housing further minor disassembly is required in order to facilitate cleaning. The workstation 100 may be used to support the air conditioner while it is being prepared for cleaning. After cleaning, the unit may be supported on both the rollers 106 and the channel assembly 102. That position allows the unit to be held stationary and provides a slight incline for the drainage of residual cleaning agent from the unit. In addition, the second part support 104 facilitates conveyance of the air conditioner from the first workstation into the enclosure.

Figure 6:
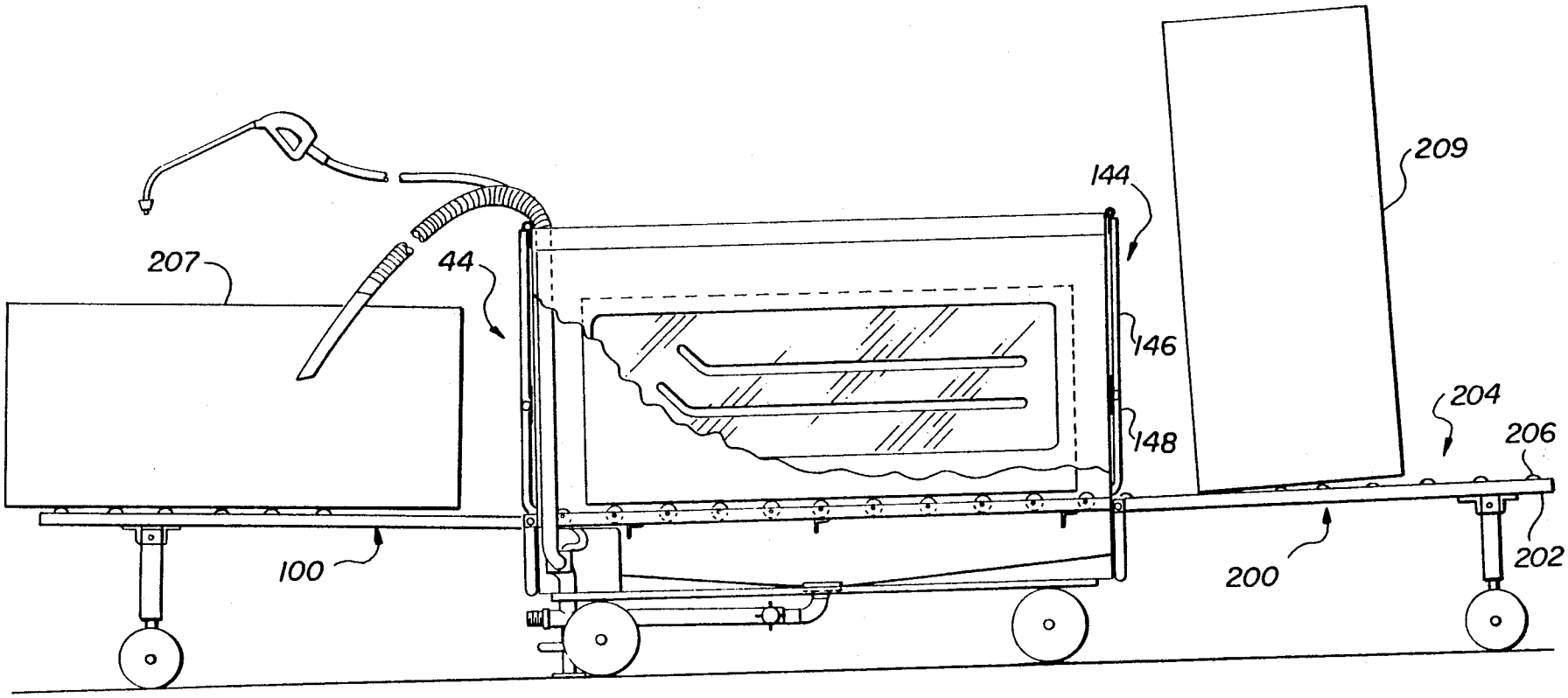
FIG. 6 is a schematic side view of a third embodiment of the cleaning apparatus of the present invention.

For additional versatility, as shown in FIGS. 4 and 6, the solid wall 71 shown in FIG. 1 may be replaced by a third access means 144 comprised of second door panels 146 and 148 joined by a hinge 150 and connected to the enclosure by hinge 152. The third access means provides even greater flexibility in using the cleaning apparatus.

FIG. 6 is a schematic side view of a third embodiment of the cleaning apparatus of the present invention. In this embodiment, the first workstation 100 may be used as a precleaning workstation; and a second workstation 200 which may be utilized as a post-cleaning workstation is located adjacent the third access means 144 comprised of second door panels 146 and 148. Further, the second workstation has a second base channel assembly 202 and a third part support 204 which are identical in construction to the first base channel assembly 102 and second part support 104, respectively. The rollers 206 are substantially coplanar with the rollers 42 and facilitate the conveyance of the air conditioner between the enclosure and the second workstation.

With this embodiment, a first air conditioner 207 may be loaded on the precleaning workstation 100. If necessary, additional disassembly is performed to facilitate cleaning. The gun 62 and wand 64 may be used to do preliminary cleaning. While that is occurring, a second air conditioner 45 may be located within the enclosure 12. The gun 62 and wand 64 are used to provide more vigorous cleaning by gaining access to the air conditioner unit via a second access such as the slots in the sidewall and the opening on the top side of the enclosure. A third air conditioner 209 may be located on the second workstation 200. While at the second workstation, water continues to drain from the unit into the second base channel assembly 202, and back to the sump 19. In addition, the vacuum hose 38, may also be used to collect residual liquid. While at the second workstation, whatever parts were disassembled at the pre-cleaning workstation 100, may now be reassembled to the unit.

In the preferred embodiment, the cleaning agent is water, which is pressurized in the range of 200–400 psi and has a temperature range of 140°–200° F. The enclosure, door panels and work stations are preferably fabricated from aluminum angle iron, bar stock and sheet. The wand 64 is brass and is terminated with a commercial T-jet sized for the application; and referring to FIG. 2, a foot-operated brake 99 is engaged against a floor or ground surface to hold the cleaning apparatus stationary during use.

Consequently, using the cleaning apparatus of the present invention air conditioners, heat/cool systems, e.g. a package terminal air conditioner manufactured by General Electric or an incremental unit manufactured by Singer/McQuay, or other parts which are difficult to move to different environments may be cleaned in close proximity to their location of use. The claimed cleaning apparatus has the advantages of reducing cleaning time, reducing labor required and reduces handling of the units thereby reducing risk of damage. Further, the invention provides a simple mechanism which permits the cleaning to occur with a minimum of spillage of cleaning agent. For example, a drop cloth may be used to collect any drops that do splash or drip beyond the confines of the unit.

In some environments the cleaning apparatus will not be able to be physically moved to the exact location of the unit to be cleaned. In those situations, the cleaning apparatus may be used with a separate smaller shuttle cart to move the unit to be cleaned from its installed location to the cleaning apparatus. Preferably, the shuttle cart has a deck the same height as a workstation rollers thereby allowing ready transfer of the unit to be cleaned from the shuttle cart to the cleaning apparatus.

While the invention has been illustrated in some detail, according to the preferred embodiments shown in the accompanying drawings, and while the preferred embodiments have been described in some detail, there is no intention to limit the invention to such detail. On the contrary, it is intended to cover all modifications, alterations and equivalents falling within the spirit and scope of the appended claims.

What is claimed is:

1. A portable apparatus for cleaning an air conditioning unit, a heat/cool system, or a heat exchanger coil with a cleaning agent, the apparatus comprising:

a chamber for receiving the air conditioning unit, heat/cool system, or heat exchanger coil and for containing the cleaning agent during cleaning, said chamber including, a sump for collecting used cleaning agent within the chamber;

opposing side walls;

a first access means located at one end of the chamber between the opposing side walls for permitting the air conditioning unit, heat/cool system, or heat exchanger coil to be transferred into the chamber;

a second access means, including apertures located on the opposing side walls of the chamber, for dispensing the cleaning agent to clean the air conditioning unit, heat/cool system, or heat exchanger coil; and a means for supporting the air conditioning unit, heat/cool system or heat exchanger coil over the sump, including a first roller conveyor means for conveying the air conditioning unit, heat/cool system, or heat exchanger coil into and within the chamber;

a first work station associated with the one end of the chamber, said first work station having a second roller means substantially coplanar with the first roller means and operating therewith for conveying the air conditioning unit, heat/cool system, or heat exchanger coil between the first work station and the chamber, a means for connecting one end of the first work station to one end of the chamber, and a transport means upon which the first work station is mounted for allowing the first work station to move in association with the chamber;

a transport means upon which the chamber is mounted;

a spray means for introducing the cleaning agent in the chamber through the second access means; and a means for removing the cleaning agent from said sump.

2. The apparatus of claim 1 wherein the chamber has an opening on a top side of the chamber, said opening providing the second access means.

3. The apparatus of claim 1 wherein the first access means is comprised of first movable elements having a first position opening the first access means to allow the part to be loaded into the chamber and having a second position closing the first access means to contain the cleaning agent during cleaning.

4. The apparatus of claim 1 wherein an opposite end of the first workstation has a higher elevation than the one end thereof, and the first workstation further includes a reservoir for collecting the cleaning agent and draining the cleaning agent into the sump.

5. The apparatus of claim 1 wherein the spraying means for introducing a cleaning agent into the chamber further comprises:

wand means for dispensing the cleaning agent; and means for connecting the wand means to a source of the cleaning agent.

6. The apparatus of claim 1 wherein the sump further comprises a drain for draining the cleaning agent therefrom.

7. The apparatus of claim 1 wherein the removing means further comprises:

a vacuum hose, and means for connecting the vacuum hose to a source of vacuum.

8. The portable apparatus of claim 1 wherein the apparatus further comprises:

a third access means, located between the two sides at an opposite end of the chamber from the one end, comprising second moveable elements having a first position opening the third access means to allow the air conditioning unit, heat/cool system, or heat exchanger coil to be loaded into the chamber and having a second position closing the third access means to contain the cleaning agent during cleaning; and a second work station associated with the opposite end of the chamber, said second work station having a third roller means substantially coplanar with the first roller means and operating therewith for conveying the air conditioning unit, heat/cool system, or heat exchanger coil between the second work station and the chamber, said second work station further comprising a means for connecting one end of the second work station to the opposite end of the enclosure and a means attached to the second work station for allowing the second work station to move in association with movement of the enclosure.

9. The apparatus of claim 8 wherein an opposite end of the second workstation has a higher elevation than the one end thereof, and the second workstation further including a reservoir for collecting the cleaning agent and draining the cleaning into the sump.

10. The apparatus of claim 9 wherein the first and second workstations have base members of a predetermined length and the first and second roller means extend along the length of the first and second workstations a distance less than the predetermined length to permit a part to be supported in part by the second and third roller means and in part by the bases members of the first and second workstations, respectively.

11. The apparatus of claim 9 wherein the chamber and the first and second workstations are made of aluminum.

* * * * *